US006127023A

United States Patent [19]

Marbler et al.

[11] Patent Number: 6,127,023

[45] Date of Patent: Oct. 3, 2000

[54] LID MATERIAL

[75] Inventors: Claude A. Marbler, Phalsbourg; Raymond Gribling, Reding; René Parmentier, Buhl; Eliane Pierron, Brouderdorff, all of France

[73] Assignee: Alusuisse Technology & Management Ltd., Neuhausen am Rheinfall, Switzerland

[21] Appl. No.: 08/970,969

[22] Filed: Nov. 13, 1997

[30] Foreign Application Priority Data

Nov. 12, 1996 [EP] European Pat. Off. ..... 96810862

[51] Int. Cl.[7] ..... B32B 3/00

[52] U.S. Cl. ..... 428/200; 428/81; 428/343; 428/347; 428/353; 215/232

[58] Field of Search ..... 428/81, 200, 343, 428/347, 353; 215/232

[56] References Cited

U.S. PATENT DOCUMENTS

| | | | |
|---|---|---|---|
| 3,272,422 | 9/1966 | Miller | 229/43 |
| 3,704,804 | 12/1972 | Kaercher et al. | 220/270 |
| 4,214,029 | 7/1980 | Barnes . | |
| 4,697,719 | 10/1987 | Allen | 220/258 |
| 4,830,215 | 5/1989 | Rebischung | 220/359 |
| 4,919,742 | 4/1990 | Rebischung | 156/269 |
| 4,934,544 | 6/1990 | Han et al. | 215/232 |
| 4,935,274 | 6/1990 | DeBenedictis et al. . | |
| 4,960,216 | 10/1990 | Giles | 215/232 |
| 4,981,229 | 1/1991 | Lanham | 215/232 |
| 5,004,111 | 4/1991 | McCarthy | 215/232 |
| 5,197,618 | 3/1993 | Goth . | |
| 5,226,281 | 7/1993 | Han et al. | 53/412 |
| 5,294,470 | 3/1994 | Ewan . | |
| 5,540,989 | 7/1996 | Maul et al. . | |
| 5,637,396 | 6/1997 | Sato et al. | 428/349 |
| 5,733,636 | 3/1998 | May | 428/200 |
| 5,766,738 | 6/1998 | Phillips et al. | 428/200 |
| 5,824,176 | 10/1998 | Stein et al. | 156/239 |
| 5,858,490 | 1/1999 | Mori et al. | 428/36.7 |
| 5,863,624 | 1/1999 | Miyazaki et al. | 428/35.9 |
| 5,866,248 | 2/1999 | Dressler | 428/343 |

FOREIGN PATENT DOCUMENTS

| | | | |
|---|---|---|---|
| 435 095 | 10/1967 | Switzerland . | |
| 1536556 | 12/1975 | United Kingdom | B32B 27/08 |

*Primary Examiner*—Terrel Morris
*Assistant Examiner*—Arti Sinah
*Attorney, Agent, or Firm*—Fisher, Christen & Sabol

[57] ABSTRACT

Lid material (10) in the form of a substrate material (5) such as a plastic film bearing a printed image (6) facing outwards with respect to the container (1) on which the lid material (10) is used, and an inward facing sealing layer (8, 9) for closing off containers (1) having a shoulder region (4). The inward facing side of the substrate material (5) bears the sealing layer (8, 9) in the form of a printed image which corresponds to the shoulder region (4) of the container. The printed image which forms the sealing layer (8, 9) can be deposited on the substrate material (5) in the same printing machine in which the printed image (6) is deposited on the substrate material (5).

10 Claims, 1 Drawing Sheet

LID MATERIAL

BACKGROUND OF THE INVENTION

1. Field of the Invention

The present invention relates to a substrate material bearing a printed image facing outwards with respect to the container on which the lid material is used, and an inward facing sealing layer for closing off containers having a shoulder region.

2. Background Art

It is known to provide a ring-shaped shoulder at the opening to containers such as e.g. deep-drawn or stretch-drawn containers or containers formed in another manner, and to lid such containers in particular after filling, such that the lid lies over the whole of the shoulder and is securely attached and sealed to the shoulder by sealing or adhesive bonding. Such beakers, dishes, menu dishes e.g. with one or more compartments, goblets, small packs etc. are e.g. known for packaging all kinds of food stuffs such as e.g. milk products, especially yogurts, whipping cream, sour milk, sour cream, coffee cream, ready-made salads or partially or fully conserved foods, pre-cooked or otherwise prepared dishes, drinks such as fruit and vegetable juices, drinking water etc.

As a rule the containers are filled and the lid material fed from an endless roll over the containers to be lidded which are continuously fed into a packaging machine. The lid material which features a sealing layer is sealed to the shoulder region at the rim of the container by means of a sealing tool. Subsequently, the lid material is cut away e.g. by means of a stamping tool or cutting blade, and the filled, lidded container packed and dispatched for sale individually or individually in groups.

The lid material may be made of a wide range of materials which depend on the requirements to be met. Typical examples are metal foils coated with plastic on one or both sides. Other lid materials are thermoplastics in the form of monofilms or multilayer laminates. Further lid materials may be of cellulose containing materials such as cellophane or paper. In order to seal the lid material to the rim of the container, the lid material is covered over its whole surface area by sealing layer such as an organic sealing coating or sealing film, whereby the sealing layer is deposited e.g. on both sides of the lid material or at least on the side facing the interior of the finished packaging i.e. towards the interior of the container.

The lid material also serves as substrate for carrying information and advertising. For that reason the lid material is provided on the outside with a printed image or reversed-image. The printing may be situated on the uppermost layer i.e. the layer facing outwards on the final container. The printing may also be covered with a protective organic coating or a protective film or, the uppermost layer or layers of the lid material may be of transparent or opaque materials and bear a reversed image. The printed images may be single or multi-coloured and deposited in a printing machine.

The lid material is manufactured e.g. such that a substrate such as a metal foil, a plastic film or a plastic film laminate is made by laminate bonding or calendering one or more layers into a multilayer laminate. The sealing layer is deposited as an organic coating or by laminate bonding on the side of the lid material facing the interior of the container. Following that, the lid material—which is e.g. in roll form—is fed into a printing machine. A further image may be printed later onto the side of the lid material facing outwards.

The disadvantage of these known methods for producing lid materials is the large number of steps involved in their preparation, in particular the high expenditure for materials for completely covering the lid material with sealing material, although only a small percentage of this sealing material is finally used for sealing purposes.

BROAD DESCRIPTION OF THE INVENTION

The object of the present invention is to overcome these disadvantages and to propose a lid material which enables the individual materials to be employed economically and which can be manufactured in a simplified manner.

That objective is achieved by way of the invention in that the inward facing side of the substrate material bears the sealing layer in the form of a printed image and the printed image corresponds to the shoulder region of the container.

The substrate material may be a monofilm of plastic or a multilayer laminate of two or more plastic layers or a metal foil or a multilayer laminate of at least one metal foil or and at least one plastic film. The substrate material may also be of cellulose containing material or contain cellulose containing material. The cellulose containing material may be coated with plastic e.g. on one or both sides or may be metallized, or may exhibit a plastic layer on one side and a metallized layer on the other side. The plastics of the substrate material may be e.g. polyolefins such as polyethylene or polypropylene, polyamide, polyethyleneterephthalate or polyvinyl chloride. Metal foils that may be used are e.g. steel or aluminum foils. Cellulose materials which may find application are e.g. paper or semi-carton material. Further substrate materials are e.g. cellophane. The substrate material may have a thickness e.g. of 15–500$\mu$m, whereby substrate materials of plastic films or metal foils or of metal foils and plastic films are preferably 15 to 150$\mu$m, while lid materials containing cellulose containing materials have a thickness e.g. of 60 to 500$\mu$m. The substrate materials are in particular so flexible that they may be coiled into rolls.

Preferred substrate materials contain a transparent, opaque or light-blocking film or laminate of at least one plastic of the following viz., a polyester, a polyolefine such as a polyethylene or a polypropylene, a polyamide, or of cellophane, or a metal foil, or a plastic-coated metal foil, or a layer material of paper with a plastic layer such as e.g. a layer of polyethyleneterephthalate which may in turn be metallised.

The substrate material may also exhibit a barrier layer against gases, vapors and moisture. In addition to the above mentioned metal foils, the barrier layers may be e.g. films of plastics such as polyvinylchloride or ethyl-vinyl-alcohol, or it may be a layer of a ceramic material such as the oxides or nitrides of silicon or aluminum deposited in a vacuum deposition process onto a substrate film as a thin layer with a thickness e.g. of the order of 10 to 500 nanometers. Further examples of barrier layers are metallic layers e.g. of aluminium deposited onto the substrate by sputtering.

A printed image may be deposited on the side of the lid material that later faces outwards from the finished container. The printing on the substrate material may be carried out using any of the known printing methods e.g. typographic, offset, flexo, screen, helio and copper intaglio printing. The choice as to which printing method is to be used depends on the quality required, on the prevailing technical details and on the numbers to be printed. Preferred is flexo-printing (also aniline or rubber printing) and intaglio printing such as copper intaglio printing, or helio-printing. The printing on the outside of the substrate material may e.g.

be covered by a protective coating, or a transparent film e.g. of polyethylene-terephthalate, polyamide, polyolefins such as polyethylenes or polypropylenes or a layer of cellophane may be protected by a laminating agent or adhesive layer.

A sealing layer is deposited on the side of the lid material facing the interior of the finished container. The sealing layer is deposited on the substrate material in the form of a printed image. The sealing layer may be deposited on the substrate material in the same printing machine used to deposit the image on the outside, or it may be deposited on a previous or subsequent printing machine. The sealing layer may advantageously be of a primer and/or a bonding agent and an organic sealing coating or may be only of an organic sealing coating. The bonding agent or the primer and the organic sealing coating are deposited one after the other in a typographic, offset, flexo, screen, helio intaglio or copper intaglio printing process preferably via flexo or helio-printing.

The sealing layer may contain or comprise of an organic sealing coating e.g. of the polyolefin and preferably polyethlyene type or a vinylacryl-copolymer or an organic coating containing an acrylic polymer or an epoxy type coating. The sealing layer may also contain the organic sealing coating and a bonding agent or primer e.g. a polyester or vinyl polymer. The bonding agent or primer is advantageously deposited on the substrate and the organic sealing coating deposited on the bonding agent or primer.

The present invention relates also to a process for manufacturing lid material from a substrate material having printing facing outwards, with reference to a container on which the lid material is used, and an inward facing sealing layer for closing off containers with a ringshaped shoulder region.

The process is carried out in such a manner that the inward facing sealing layer is deposited on the substrate by means of a printing process, whereby the printed image corresponds to the shoulder region of the container.

Preferred is a process for manufacturing lid materials according to the present invention in which the inward facing sealing layer and the outward facing printed image are deposited in a printing machine by printing on both sides of the lid material.

The present invention also relates to the use of the lid material made of a substrate material having printing facing outwards, with reference to a container on which the lid material is used, and an inward facing sealing layer, where the inward facing sealing layer is in the form of a printed image that corresponds to the shoulder region on which the substrate material is laid and is for closing off the container by sealing it at the shoulder region.

DETAILED DESCRIPTION OF THE INVENTION

Figure 1:
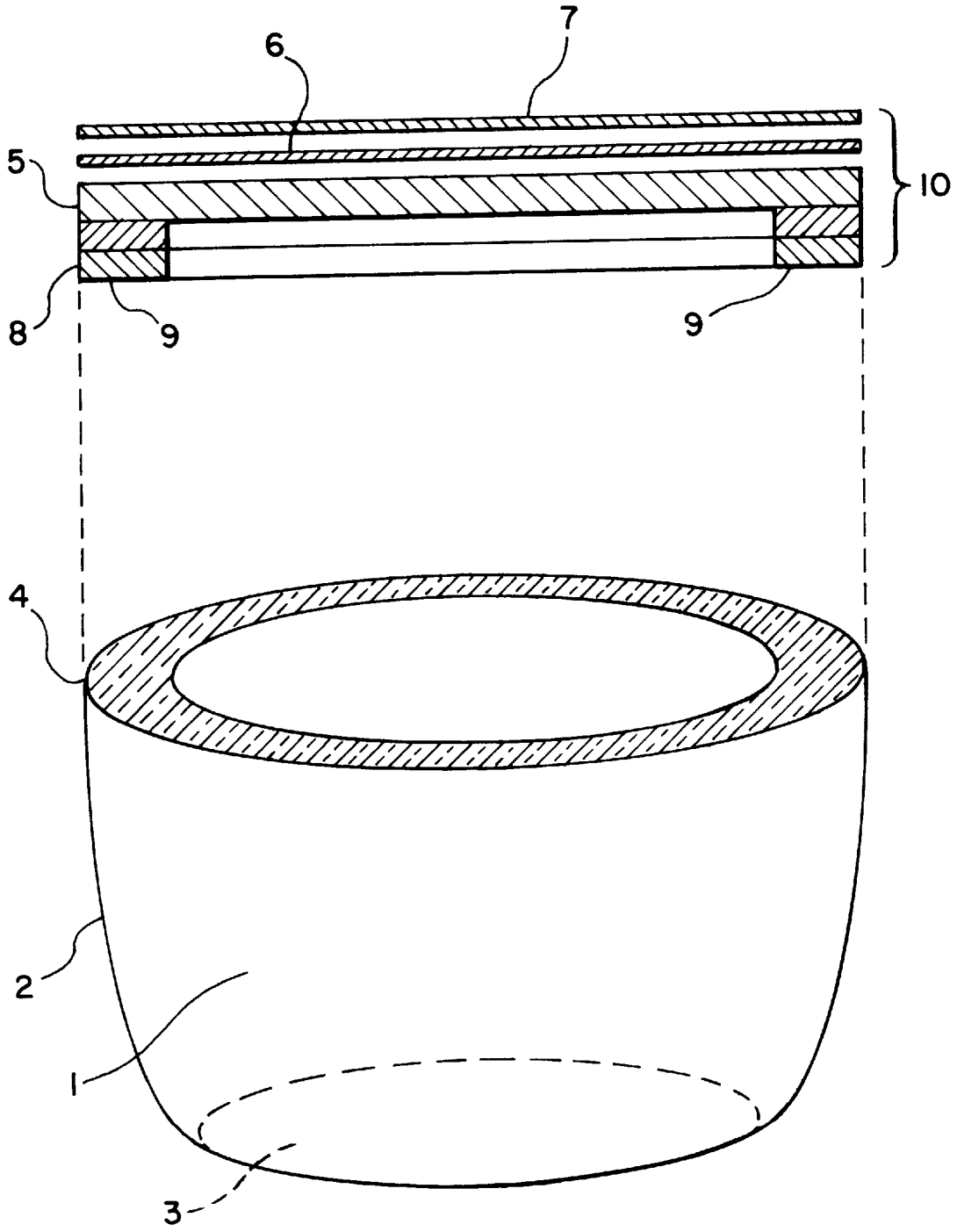

FIG. 1 shows schematically and by way of example a beaker 1 comprising sidewall 2, base 3 and upper rim which forms the shoulder 4. After the container has been filled e.g. with foodstuff or a drink such as yogurt, jam, dried fruit, a chocolate pudding or another dessert, or with drinking water or fruit and vegetable juices, the beaker 1 is covered with the lid 10 and the lid 10 sealed to the beaker 1 along the shoulder 4. The lid 10 contains a substrate material 5 on which is a printed image 6 and a protective layer 7 e.g. in the form of a protective organic coating or a protective foil. The sealing layer of primer 8 and organic sealing coating 9 is deposited only locally on the side of the substrate material 5 facing the container or container interior viz., in the region of the shoulder 4 of the container 1 and corresponding to or approximately corresponding to the image of the ring-shaped shoulder 4 of the beaker 1. The sealing layer of primer 8 and organic sealing coating 9 is deposited on the lid 10 only or essentially only at that place on the substrate 5 which comes into contact with the shoulder 4. This is indicated schematically by the broken lines. In the present example this would mean that that the sealing layer 8, 9 is printed on the substrate 5 in the shape of a ring. Of course that printed image may diverge slightly from the shoulder region 4 of the beaker 1. For example in the case of a very broad shoulder 4, the printed image of the sealing layer 8, 9 may be narrower e.g. 1 to 50% narrower than the breadth of the shoulder 4 of the container 1 or, in order to compensate for machine inaccuracies, the area of the printed image of the sealing layer 8, 9 may be made some percentage e.g. 1 to 25% greater than the surface of contact between the lid material and the shoulder region 4.

The lid material in question here may be sealed onto the container rim via the sealing layer. The choice of sealing tool, the sealing pressure and the sealing temperature determines the strength of the seal. Tear-off facilities e.g. in the form of less strongly sealed or jagged regions may also be provided at the sealed searn. Instead of the printed sealed layer bonding may be effected with an adhesive such as a contact adhesive or an adhesive that bonds under the action of heat and/or pressure. This provided the adhesive can be applied in a printing machine and can be printed onto the lid material.

The lid material according to the invention has the advantage that the starting materials are utilized extremely economically, especially in that the primer or bonding agent and organic sealing coating are used only in small amounts where they are actually needed. Typically the primer or bonding agent are used in amounts of 0.2 to 30 g, preferably 3 to 20 g per square meter and the organic sealing coating in amounts of 0.5 to 30 g, preferably 1.5 to 20 g per square meter, in particular in each case 6 to 10 g / $m^2$. As the primer or bonding agent and the organic sealing coating normally have to be dissolved in a solvent in the printing machine, the amount of solvent to be evaporated is reduced considerably. This is expressed both in terms of the energy consumption and in the amount of solvent consumed. The process according to the invention is also advantageous in that the production of the lid material requires one machine step less. The sealing layer must not be deposited separately as a layer or film, but can instead be applied while depositing the printed image in the same process step and in some cases in the same printing machine.

The present invention can be realised both on rolled products or endless strips of material or on individual lids, whereby the sealing layer can be deposited on endless strip material and the lids can be processed individually by stamping or cutting, or individual lids may be stamped or cut out of endless lid material and the sealing layer subsequently printed onto these individual lids. For machine printing purposes the individual lids may e.g. be stuck onto an endless conveyor belt for the printing operation. The finished lid may feature a tear-off or gripping tab and/or weaknesses e.g. in the form of perforations or tearing notches which make the opening of the container easier by removing the lid.

As the sealing layer on the lid is present essentially only in the shoulder region of the facing container, the risk of constituents in the sealing layer diffusing out of that layer into the container contents and e.g. aromas or flavors influencing the contents is minimized.

The present invention also makes possible completely or almost completely transparent lid materials as the organic sealing coating is deposited only at the places required for sealing and not over the whole of the lid area; consequently substrate material remains completely transparent. The transparent substrate materials do not become less transparent due to any layers of the organic sealing coating or to the primer.

What is claimed is:

1. A lid (10) for placing on a container (1) which has a shoulder region (4), said lid (10) includes a substrate material layer (5), the substrate material (5) has a surface which faces outwards with respect to the container (1) and a surface which faces inward with respect to the container (1), and an inward facing adhesive sealing layer (8, 9) for closing off the container (1) having the shoulder region (4), located on the inward facing surface of substrate material layer (5), the adhesive sealing layer (8, 9) is deposited in the form of a printed image only locally on the substrate material layer (5) and only or essentially only at that place on the substrate material layer (5) which would align with the shoulder region (4) of the container (1) when the lid (10) is placed on the container (1).

2. Lid material according to claim 1, wherein the sealing layer contains an organic sealing coating (9).

3. Lid material according to claim 1, wherein the sealing layer contains a bonding agent and/or a primer (8) and an organic sealing coating (9).

4. Lid material according to claim 1, wherein the sealing layer contains a bonding agent and/or a primer which is a polyester or vinylpolymer and an organic sealing coating containing polyolefins and preferably polyethylenes, or vinylacryl copolymer or acrylpolymer-containing coating or epoxy coating.

5. Lid material according to claim 1, wherein the substrate material contains thermoplastics or a cellophane or a cellulose containing material or a metal foil or a combination of these materials.

6. Lid material according to claim 5, wherein the substrate material contains a combination of at least one thermoplastic and/or a cellophane and/ or a cellulose containing material and/or a metal foil in the form of a multilayered composite material.

7. Lid material according to claim 5, wherein the substrate material contains a barrier layer against gases, vapors and moisture which is a ceramic layer or a metallized layer or a plastic film or a metal foil.

8. Process comprising sealing off a container at the shoulder region by means of the lid material of claim 1.

9. Process for manufacturing lid material for closing off containers having a shoulder region, from a substrate material and an adhesive sealing layer (8, 9) for closing off the containers having the shoulder region on the surface of the substrate material facing inward with respect to the container, the inward facing side of the substrate material bears the adhesive sealing layer (8, 9) and the sealing layer is deposited in the form of a printed image only locally on the lid and only or essentially only at that place on the substrate which comes into contact with the shoulder region of the container.

10. Process for manufacturing lid materials according to claim 9, wherein the inward facing sealing layer and the outward facing printed image are deposited in a printing machine by printing on both sides of the endless lid material.

* * * * *